US005573498A

United States Patent [19]

Hayek

[11] Patent Number: 5,573,498

[45] Date of Patent: Nov. 12, 1996

[54] CHEST ENCLOSURES FOR VENTILATORS

[75] Inventor: Zamir Hayek, London, England

[73] Assignee: Dranez Anstalt, Vaduz, Liechtenstein

[21] Appl. No.: 350,738

[22] Filed: Dec. 7, 1994

Related U.S. Application Data

[63] Continuation of Ser. No. 858,141, Mar. 27, 1992, abandoned.

[30] Foreign Application Priority Data

Mar. 28, 1991 [GB] United Kingdom ..... 9106717

[51] Int. Cl.[6] ..... A61H 31/00

[52] U.S. Cl. ..... 601/41; 601/43; 601/44

[58] Field of Search ..... 601/41–44

[56] References Cited

U.S. PATENT DOCUMENTS

| | | | |
|---|---|---|---|
| 2,227,847 | 1/1941 | Shoolman | 601/44 |
| 2,287,939 | 6/1942 | Kraft | 601/44 |
| 2,360,476 | 10/1944 | Church | 601/44 |
| 2,466,108 | 4/1949 | Huxley, III | 601/44 |
| 2,749,910 | 6/1956 | Faulconer, Jr. | 601/44 |
| 2,759,474 | 8/1956 | Kling | 601/44 |
| 2,772,673 | 12/1956 | Huxley, III | 128/30.2 |
| 3,043,292 | 7/1962 | Mendelson | 601/44 |
| 3,368,550 | 2/1968 | Glascock | 601/44 |
| 4,257,407 | 3/1981 | Macchi | 601/44 |
| 4,770,165 | 9/1988 | Hayek | 601/42 |
| 4,815,452 | 3/1989 | Hayek | 601/44 |
| 4,930,498 | 6/1990 | Hayek | 601/44 |
| 5,076,259 | 12/1991 | Hayek | 601/44 |

FOREIGN PATENT DOCUMENTS

| | | |
|---|---|---|
| 0379049 | 7/1990 | European Pat. Off. . |
| 0329506 | 8/1903 | France . |
| 0797975 | 5/1936 | France . |
| 0862703 | 3/1941 | France . |
| 0565434 | 11/1932 | Germany . |
| 0688387 | 2/1940 | Germany . |
| 0752783 | 7/1956 | United Kingdom . |
| 0763476 | 12/1956 | United Kingdom . |
| 0826003 | 12/1959 | United Kingdom . |
| 2200557 | 8/1988 | United Kingdom . |
| 2226959 | 7/1990 | United Kingdom . |

*Primary Examiner*—Aaron J. Lewis
*Attorney, Agent, or Firm*—Cushman, Darby & Cushman

[57] ABSTRACT

A chest covering shell (4) of springy material for fitting over a patient's chest is coupled to an air oscillator. Changes in air pressure in the shell (40) cause ventilation of the patient. A back plate (10) can be used which has vertically extending supports (14) for engagement with the sides (28) of the shell (40) so as to support them and prevent their flexing during use. The edge of the shell (4) has a seal (50 which runs continuously around the periphery of the shell (40). The seal (50) can include an inwardly directed flap (56) in order to provide an effective seal when positive pressures are applied under the shell (40). A backing pad (58) comprising an evacuatable envelope containing solid particles can be used which is able to support the shell (40) and seal against the patient. The pad (58) can be deformed by the weight of the patient and can be evacuated via air outlet (70) to stiffen the envelope by compression of the particle.

22 Claims, 5 Drawing Sheets

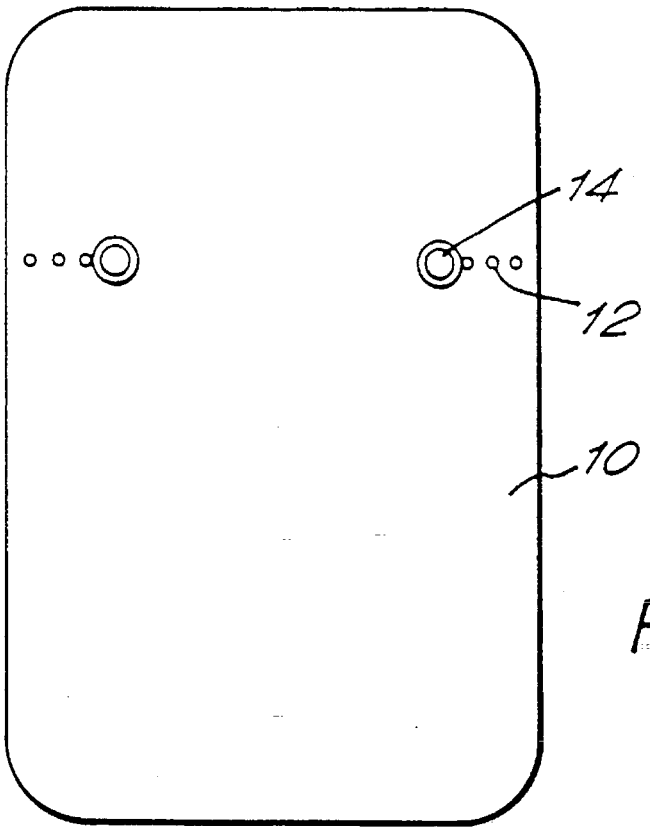
FIG.1.
FIG.2.
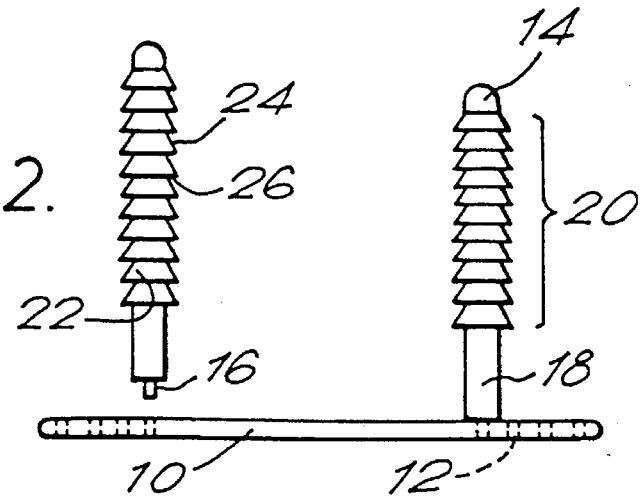

CHEST ENCLOSURES FOR VENTILATORS

This is a continuation of application Ser. No. 08/858,141, filed on Mar. 27, 1992 now abandoned.

FIELD OF THE INVENTION

The present invention relates to chest enclosures for use in producing assisted ventilation of the lungs of a patient when combined with an air oscillator.

BACKGROUND TO THE INVENTION

In medical practice it is frequently necessary to assist the breathing of a patient. Most frequently this is done by intubating the patient and applying periodic positive air pressure through the intubation into the patient's lungs. Intubation is associated with a number of clinical and practical disadvantages.

The alternative to intubation is to use some form of external ventilator apparatus. External ventilator apparatus of the so-called "Cuirass Ventilator" type has a long history. Until recently, such devices have been of limited usefulness. In our British Patent Specification No. 2226959A, we have described chest enclosures for use in producing assisted ventilation which have proved successful in practice. However, we have found that there are a number of aspects in which still further improvement is possible.

First, we have found that there is some tendency for the top surface of the chest enclosure or shell to move downwardly when suction is applied to the enclosure by the oscillator so as to produce a substantial sub-ambient pressure within the enclosure formed by the shell. The top surface of the shell is drawn downwardly against the patient's chest creating pressure on the chest partially blocking its expansion and this reduces the effectiveness of the ventilating action of the air oscillator to a degree.

Secondly, one of the principal advantages of the chest enclosure described in the application referred to above is the speed with which it can be applied to a patient. The chest enclosure described had bands of closed-cell foam extending from its side edges which were to be wrapped around the patient in overlapping relationship and fastened by straps. We have found that it is possible to devise an edge seal for the shell which enables the shell to be applied over a patient and to form a seal sufficient for use whilst the patient is lying supine and still, even without the use of fastening straps, at least as a temporary measure.

Furthermore, we have devised a form of seal for the shell still better adapted to resist the escape of super-ambient pressure from the shell during use.

SUMMARY OF THE INVENTION

According to a first aspect of the present invention there is provided a chest enclosure for use in producing assisted ventilation of the lungs of a patient comprising a chest covering shell of springy material for fitting over a patient's chest, said shell having side portions for extending over the sides of a patient's body, means for sealing the shell against a patient's body, an air passageway into said enclosure for connection in use to an air oscillator, said enclosure further comprising a support structure comprising a base member to be located beneath a recumbent patient's back, one or more support members rising from said base member, and means for engaging said shell with said support member or members, whereby to restrain bowing of the side portions of the shell in response to sub-ambient pressure within the shell.

The said one or more support members for engagement with the shell may be integral with the said base member The base member may take the form of a plate which is sufficiently thin that a patient can lie over it without discomfort with portions of the patient overhanging the plate. Suitably the plate is between 3 and 10 mm thickness, e.g. about 5 mm in thickness. It is suitably formed from a rigid plastics material such as perspex.

Preferably, there are at least a pair of support members rising from such a base member, one of said pair being disposed on each side of the patient in use so that the patient lies between the support members and the shell is engaged by both support members of the pair. Preferably, the shell is engaged by the support members at a location toward the top of the shell, e.g. at about the top of a or each side portion of the shell.

Preferably, the height of the top of the shell when the shell is engaged with the support members is user selectable.

The support members may each take the form of a support column having a series of locations along its length at which engagement means on said shell can be engaged with the column.

Preferably, one support member of the or each pair of support members is removable from the base member to allow the base member to be slid underneath the patient with minimal lifting of the patient. The support member can then be replaced on the base member. The support member may be removably located on the base member for instance by a screw-in fitting. However, other forms of connection such as quick release couplings are envisaged.

Preferably, the space between the or each pair of support members is upwardly open so that a patient fitted with a chest enclosure shell can be lowered between the two columns of the pair and the shell can then be engaged with the support members.

The support members may take the form of a columns which are sufficiently flexible to be deflected apart and to spring inwards to grip a shell located between them. They may be provided with a series of tooth formations engagable by a dog or tongue provided on the adjacent portion of the shell. Alternatively, engagement means may be provided on the shell which is protrudable toward the support member to locate therewith. For instance, the support member may be a column and the shell may be provided with a collar which is sliding fit over the column and is provided with an inwardly directed latch member or with an inwardly directed screw to locate against the column.

Instead of a plate the base member may be an evacuatable envelope having an opening for the evacuation of air therefrom and containing a multitude of small particles, such that the envelope is normally flexible and able to be conformed to a patient's body but upon evacuation of the air therefrom becomes stiff.

Preferably, when such a base member is used the side portions can be turned upwards so that they overlap against side portions of the shell. The upturned portions can be attached to the shell so that on evacuation of the envelope to make it stiff the upturned portions become upwardly directed support means which serve to restrain movement of the shell side portions caused by pressure changes within the shell.

In accordance with a second aspect of the invention there is provided a chest enclosure for use in producing assisted ventilation of the lungs of a patient comprising a chest covering shell of springy material for fitting over a patient's chest, said shell having side portions for extending over the sides of a patient's body, an air passageway into said enclosure for connection in use to an air oscillator, said shell having a front edge portion, opposed side edge portions and a rear edge portion, and means for sealing said edge portions against a patient's body, said sealing means including a sealing flap of resilient, flexible, air impermeable material running continuously around said front, side and rear edge portions.

Said flap may for instance be of closed cell synthetic or natural foam rubber. Suitably, such a flap may be of 2 to 5 cm in width and from 3 to 10 mm, e.g. about 5 mm in thickness. It is preferably so arranged that in use it extends from the edge of the shell or from a further sealing member attached to edge of the shell, to contact the patient's body and in such a direction that its free edge is directed away from the interior of the enclosure. By such an arrangement, when there is sub-ambient pressure within the enclosure, external air pressure tends to force the sealing flap more closely against the patient's body to provide a still better seal.

Those portions of the flap extending along the side edge portions of the shell preferably engage against the patient's back.

By the adoption of such a sealing flap, it is possible to arrange that a springy enclosure shell can be fitted over a patient's chest by pulling the sides of the shell somewhat apart and may be allowed to relax to grip the patient such that the flap forms an adequate seal to allow immediate use of the enclosure for ventilation even without the fitting of straps around the patient. Of course, it may be desired to fit straps later to retain the shell on the patient, for instance if the patient is to be moved or is capable of spontaneous movement. Also, it may be necessary to use straps around the patient if the patient's body is not of a normal shape.

In a third aspect, the invention provides a chest enclosure for use in producing assisted ventilation of the lungs of a patient comprising a chest covering shell of springy material for fitting over a patient's chest, said shell having side portions for extending over the sides of the patient's body, an air passageway into said enclosure for connection in use to an air oscillator, said shell having a front edge portion, opposed side edge portions and a rear edge portion, and means for sealing said edge portions against a patient's body, said sealing means including an inwardly directed sealing member of resilient, flexible, air impermeable material running over part or all of said front, rear and side edge portions and so directed as to overlie the surface of a patient's body in use in such a way that super-ambient pressure within said enclosure presses said sealing member more closely against said patient's body.

Such a sealing member may take the form of a sealing flap extending inwardly from the edge of the shell or from a sealing member attached to the edge of the shell. Preferably, the flap runs continuously over the whole of the front, rear and side edge portions of the shell. Its dimensions and composition may be similar to those of the sealing flap described in connection with the second aspect of the invention. However, where the sealing member is a flap, it is angled inwardly so that its free edge is directed toward the interior of the shell to overlie the patient's body within the shell. In traditional cuirass ventilators, there has been no necessity for sealing the shell against super-ambient pressure within the shell. Such ventilators have been employed with air oscillators which produce periods of sub-ambient pressure within the shell followed by relaxation to atmospheric pressure rather than with oscillators which produce periods of super-ambient pressure alternating with sub-ambient pressure.

According to a fourth aspect of the invention there is provided a chest enclosure for use in producing assisted ventilation of the lungs of a patient comprising a chest covering shell for fitting over a patient's chest, said shell having an air passageway to said enclosure for connection in use to an air oscillator, and backing means for location behind the patient in use, the said backing means comprising an evacuatable envelope having an opening for the evacuation of air therefrom and containing a multitude of small particles, such that the envelope is normally flexible and able to be conformed to a patient's body but upon evacuation of air therefrom becomes stiff.

The backing means may function in conjunction with the cuirass shell to create a box-like enclosure enclosing the chest and associated back region of a patient in a substantially air-tight manner. Side regions of the shell are in such an arrangement connected in an adequately air-tight manner to the backing means. However, the backing means may instead act as the base member as described in connection with the first aspect of the invention.

The backing means may include more than one such envelope. The envelopes may be provided separately or connected together.

In use the weight of the patient causes the distortion of the backing means into a shape which exactly fits the patient. Removing the air from the backing causes the small particles to become locked to one another thereby causing the backing means to harden and become stiff. The degree of evacuation of the envelope can be controlled in order to adjust the firmness of the backing means.

The source of the vacuum for evacuating the envelope may be a vacuum pump or a syringe.

The opening in the envelope preferably includes a valve and the degree to which the backing means can be made more resistant to compression may be controlled by operating the valve.

The valve may be a two-way vacuum valve.

The said multitude of small particles may be sand or they may be small particles or beads made of plastics, glass or metal.

Combinations of different kinds of small particles may be used.

As mentioned above, the backing means and the shell may be linked together by fastening means.

Preferably the fastening means are male and female refastenable sealing strips such as male and female hook and loop fabric strips, e.g. Velcro. The sealing strips may run longitudinally down each side of the cuirass shell and backing means. Male and female sealing strips may be provided between the cuirass shell and the straps. Alternatively, straps may be provided which are attached to the backing means and run over portions of the front and rear ends of the cuirass shell.

Straps may be fixed to the cuirass shell and extend under portions of the backing means.

The side portions of the backing means may be turned upwards or be capable of being turned upwards so that they can overlap with side portions of the cuirass shell. Preferably, such upturned side portions of the backing means overlap with portions of the outside of the cuirass shell.

The backing means may be attached to the cuirass shell using fastening means such as clips, clamps or straps and buckles. Any one of the means of attachment described in connection with the first aspect of the invention can also be used to attach the backing means to the shell.

The backing means may further include an upper layer of soft material. This soft layer is intended to make contact with the patient's back in use. The soft material layer is for the insulation and comfort of the patient and may be attached to the envelope by gluing, or if a plastics or rubber material, by welding. Alternatively, the soft material may be integrally formed with the envelope.

The soft material may be a foamed material.

The distance between the walls of the envelope in use is preferably from 1 to 1.5 cms.

Preferably the backing means is substantially rectangular in shape and corresponds generally in size to the open underside of the cuirass shell.

Preferably, the backing means is made from a flexible plastics material or rubber.

The backing means may be provided in a size suitable for use with a correspondingly sized cuirass shell, e.g. sizes suitable for neonatal, paediatric or adult use.

Preferably of course, chest enclosures according to the invention are provided which embody the features of any two or more of the four aspects identified above within a single chest enclosure. In particular, it is preferred that there be a pair of sealing flaps running around the whole of the front, rear and side edge portions of the shell, one being directed such that its free edge faces out from the enclosure in use and the other being directed so that its free edge faces in towards the interior of the enclosure, both overlying the patient's body and sealing there against. By this means, whether the pressure inside the enclosure is above or below ambient, an improved seal is achieved and there is a still further reduced need for the employment of sealing straps. This can enable a chest enclosure according to the most preferred embodiments of the invention to be applied to a patient's body and be in operation at least as fast as the most skilled operator can carry out an intubation.

Preferably, the edge seal of a shell in an enclosure according to the second or the third aspect of the invention comprises a sealing bead of closed cell foam protruding inwardly from the inner face of the shell itself by from 1 to 4 cm, e.g. about 2 cm. From the internal face of the sealing bead there preferably protrudes the sealing flap according to the second aspect of the invention and/or the sealing member required by the third aspect of the invention. Where both are provided, they preferably extend from the sealing bead at an angle to one another which is from about 30° to about 90°. Preferably, the angle included between the two is smaller at the front and rear of the shell and larger at the side edge portions of the shell. At the front and at the rear it is for instance in the region of 30° to 50° and at the sides it is preferably in the region of 70° to 90°.

The shell in each aspect of the invention is preferably constructed from a stiff but resilient plastics material such as perspex or polycarbonate, e.g. of about 0.5 to 4 mm thickness, larger thicknesses in this range being more appropriate for larger shells. Preferably it is transparent. It may be moulded into the required shape but a plane sheet of suitable material can simply be bent to form a U-shaped channel to constitute the shell.

Any of the first, second or third aspects of the invention described above may be used in combination with the backing means of the fourth aspect of the invention.

The invention will be further explained and illustrated by the following description of a preferred embodiment with reference to the accompanying drawings in which:

BRIEF DESCRIPTION OF THE DRAWINGS

FIG. 1 is a plan view of a base member with support members for use in accordance with the first aspect of the invention;

FIG. 2 is a front elevation of the base member illustrated in FIG. 1;

DETAILED DESCRIPTION OF PREFERRED EMBODIMENTS

Figure 8:
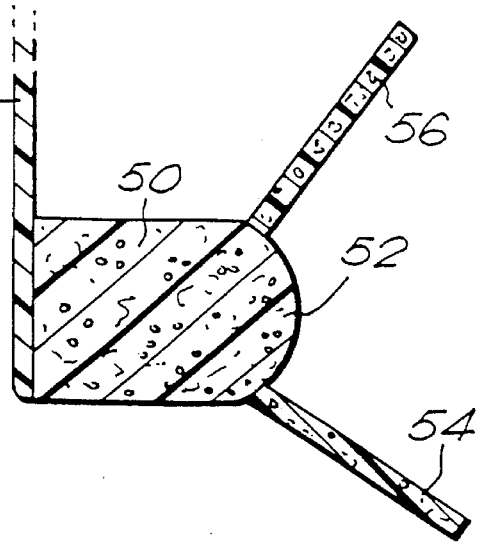
FIG. 8 is a section on the line VIII—VIII of FIG. 7.
Figure 9:
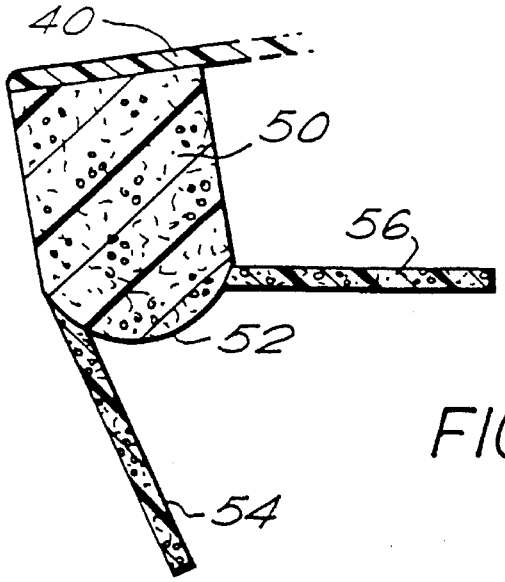
FIG. 9 is a section on the line IX—IX of FIG. 7.
Figure 10:
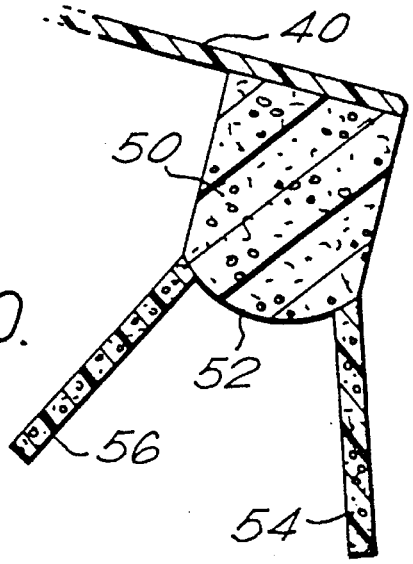
FIG. 10 is a section on the line X—X of FIG. 7.
Figure 11:
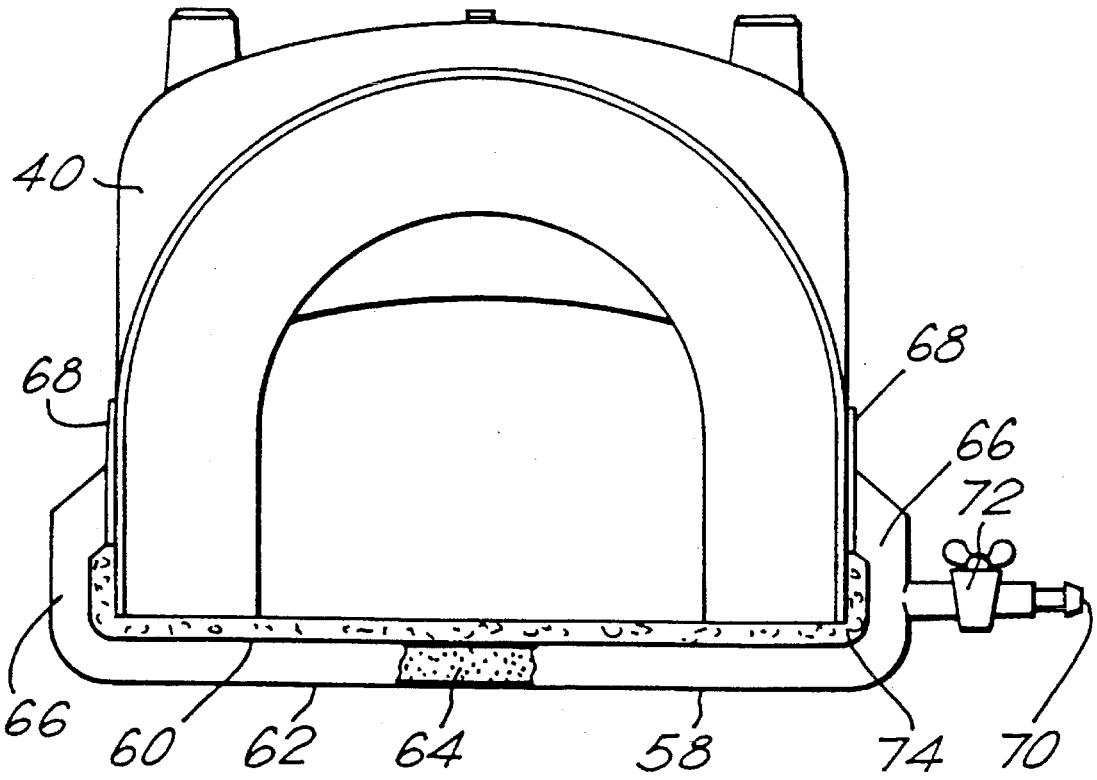
FIG. 11 is a rear elevation of the shell and back support means of an embodiment according to the fourth aspect of the invention.

In each of FIGS. 8 to 10, those portions of the enclosure which lie behind the plane of the section have been omitted for clarity.

As shown in FIG. 1, a chest enclosure according to the first aspect of the invention includes a base member in the form of a base plate 10 which is generally rectangular in shape and approximately one third of the way along its length has a transverse row of eight threaded through holes 12 arranged in two groups of four, each group lying adjacent to and extending in from one long edge of the plate 10. A pair of support members in the form of columns 14 are screwed into respective ones of the holes 12 by means of threaded studs 16 (FIG. 2). Each column is circular in cross-section and comprises a first lower plain portion 18 carrying the stud 16 and an upper toothed portion 20 comprising about fifteen frustoconical regions 22 each having an upwardly facing sloping face 24 and a downwardly facing annular face 26 lying parallel to the base plate 10.

The columns are preferably made of a tough fairly stiff but resilient plastics material.

Figure 3:
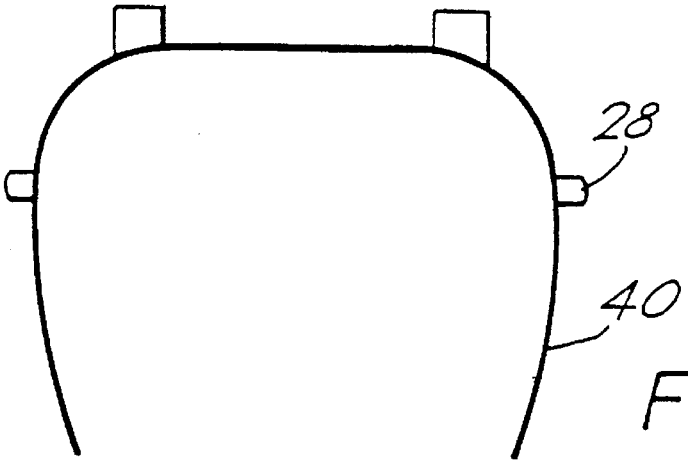
FIG. 3 is a front elevation of the shell of a chest enclosure according to the first, second and third aspects of the invention with its sealing member omitted for clarity.

The shell 40 shown in FIG. 3 may be generally conventional except for the provision of a pair of outwardly facing mounting brackets 28 positioned one on each side of the shell toward the top of the shell. Alternatively, the shell can be provided with suitable sealing members such that it is in accordance with the second and third aspects of the invention.

Figure 4:
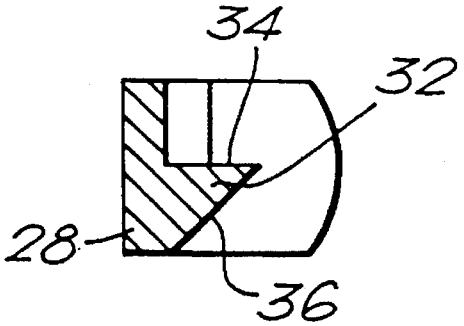
FIG. 4 is a vertical cross-section through one of the mounting brackets of the shell of FIG. 3.
Figure 5:
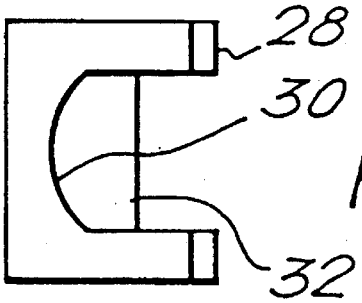
FIG. 5 is a plan view of the mounting bracket of FIG. 4.
Figure 6:
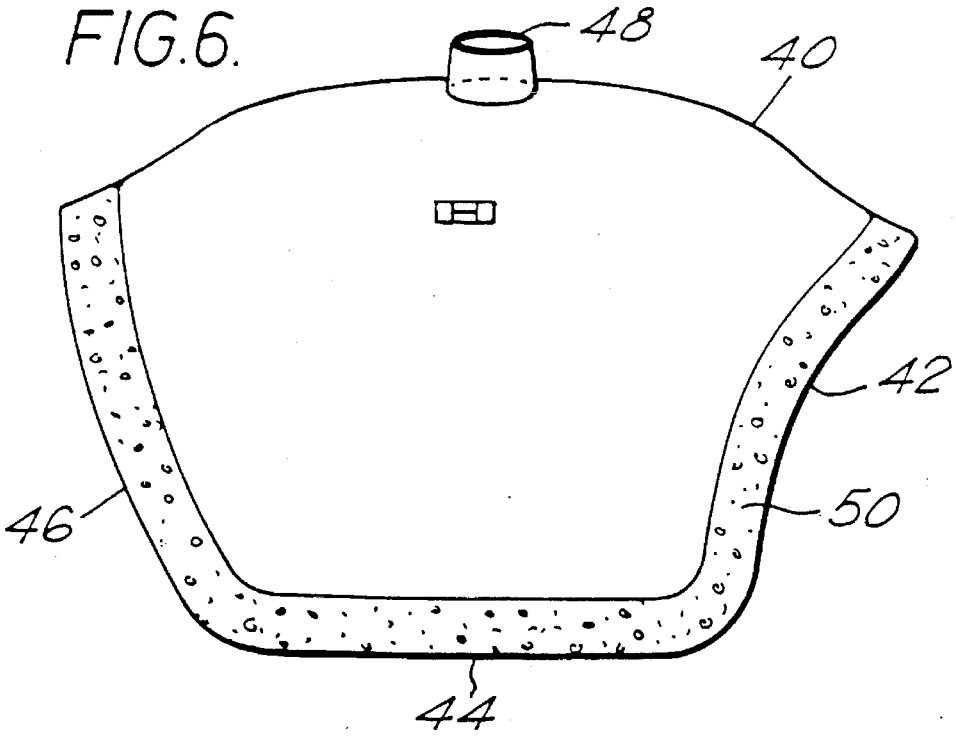
FIG. 6 is a side elevation of the chest enclosure of FIG. 3 including the sealing member.
Figure 7:
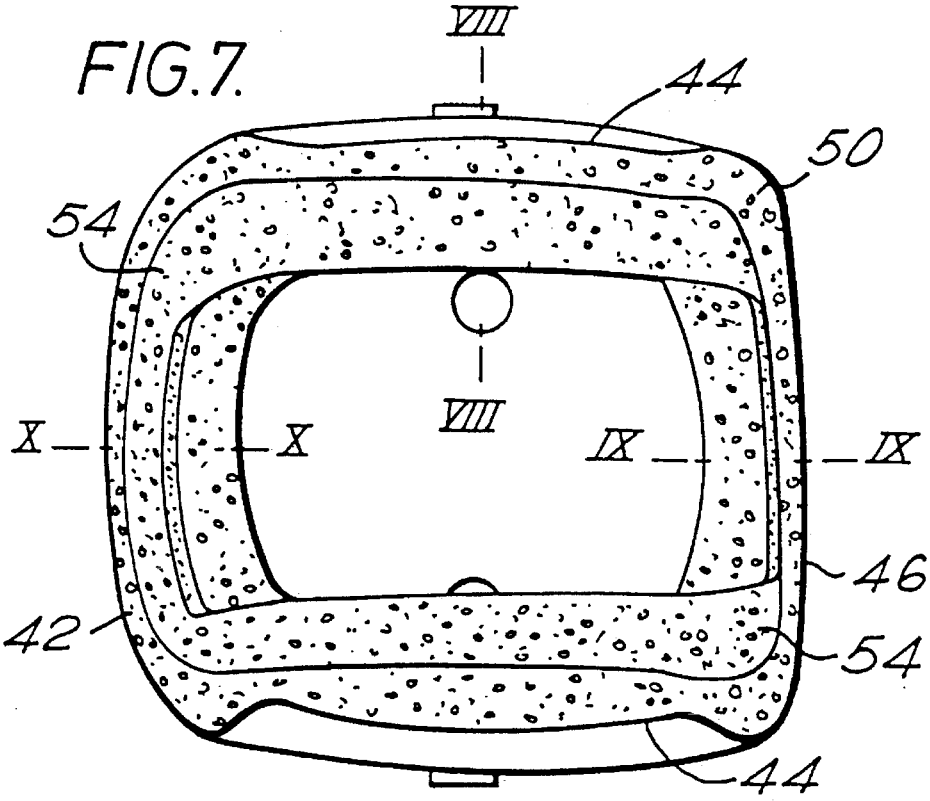
FIG. 7 is an under plan view of the shell of FIG. 6.

As shown in FIGS. 4 and 5, each mounting bracket defines a vertically extending U-shaped channel 30 having a wedge-shaped dog 32 extending out from the base of the channel and providing a horizontal upper semi-circular surface 34 and a downwardly facing sloping rectangular face 36. Below the level of the dog 32, the shape of channel 30 changes to being rectangular rather than U-shaped.

The manner of use of the enclosure described is as follows. With a patient fitted with the shell and lying on a bed, one of the two columns 14 is unscrewed from the base plate 10 and the base plate is pushed underneath the patient so that the other column 14 lies by the patient's side. The first column 14 is then refitted to the base plate on the other side of the patient. The spacing of the columns 14 is selected such that they press against the mounting brackets 28 and the dog of each mounting bracket locates under one of the annular faces 26 of the frustoconical regions 22 on each column. When vacuum is applied to the air passageways of the shell, external air pressure will tend to push the top of the shell down on to the patient's chest with consequent bowing out of the side of the shell. This will be prevented by the engagement of the mounting brackets 28 with the columns 14.

An alternative manner of use is to first fit the shell 10 pushing the mounting brackets down ratchet-wise between the columns 14 until the patient is lying on the base plate 10.

The columns of the base plate are easily removed if it is necessary to move the patient. Alternatively, the mounting brackets can be released simply by pulling apart the tops of the columns 14.

If desired, the mounting brackets and the formations on the columns 14 may be made such that it is necessary to press the mounting brackets down slightly before they can be released from the columns 14. For instance, an upstanding lug may be formed on the upper surface 34 of the dog 32 and a downwardly facing co-operating lug may be formed on each annular face 26 of the column 14.

The shell illustrated in FIGS. 3 to 7 constitutes a chest enclosure according to the second, third and fourth aspects of the invention. Shell 40 is of springy plastics material having a front edge 42 a side edge 44 and rear edge 46. It comprises a pair of air passageways 48 for connection to a suitable air oscillator, one passageway being provided on each side of the mid line of the shell.

With reference also to parts of FIGS. 8–10 there is a thick sealing bead 50 of closed cell resilient foam which extends around the internal face of the shell around the front, side and rear edges in a continuous strip. The sealing bead 50 is of generally rectangular cross-section having a rounded nose portion 52.

In accordance with the second aspect of the invention, a sealing flap 54 of closed cell foam similar to that used for the sealing bead 50 extends from the sealing bead 50. Flap 54 is of 5 mm thick foam strip about 2 cm wide. More generally, such a flap is suitably from 3 to 10 mm in thickness, and from 1.5 to 4 cm in width, larger figures within these ranges being more appropriate for larger shells. It is attached by one edge face to the outer root portion of the face of the nose portion 52 of the bead 50, e.g. by adhesive, although of course it could be made integral with the bead 50. The flap 54 extends generally at an angle with respect to a perpendicular to the edge of the shell of from about 0° to 10° outwards in the vicinity of the side of the shell to about 0° to 20° inwards in the region of the front of the shell and about 0° to 10° outwards in the region of the rear of the shell. However, when the shell is placed over a patient, the free edge of the flap can be teased outwards to lie on the body of the patient outside of the shell or at least directed towards the outside of the shell so that atmospheric pressure tends to press the flap more tightly against the patient's body.

In accordance with the third aspect of the invention, a second sealing flap 56 extends inwardly from the bead 50. This is attached to the bead 50 along the nose portion thereof spaced inwardly from the flap 54 by approximately 15 mm. Its dimensions are similar to those of the flap 54 but it is directed toward the interior of the shell so that in use it lies on the body of a patient within the shell and is pressed more tightly against the patient's body in response to super atmospheric pressure in the shell. It extends from the bead 50 at an angle to the adjacent part of the shell of about 5° to 20° in the region of the sides (FIG. 8) and front (FIG. 9) of the shell and about 20° to 60° in the region of the back (FIG. 10) of the shell. The angle included between the two sealing flaps is about 45° at the back of the shell about 70° to 90° along the sides of the shell and about 60° along the front of the shell. The entire sealing structure of bead 50 and flaps 54 and 56 can be made as an integrated whole or assembled from separate constituents.

In use, the enclosure may be fitted to a patient by springing apart the sides of the shell and passing the sides of the enclosure over the patient's chest and releasing them so that the sealing flaps 54 and 56 seal on the patient's body. In the region of the sides of the shell, the flaps, particularly the flap 50, seals against the patient's back so that movement of the patient's ribs is not restricted.

The shell may be fitted with mounting brackets so as to bring the enclosure within the first aspect of the invention. Such mounting brackets may be as illustrated or may for instance take the form of collars with an adjustment screw passing through the wall of each collar. Such collars can be fitted over support columns and held in position by tightening of the screws.

The shell may be fitted with straps to enable it to be strapped on to a patient. It may be necessary to employ such straps if the patient has a chest region of abnormal shape or if the patient is to be moved wearing the enclosure but the seal provided by the sealing flaps 54 and 56 should under normal circumstances be sufficient to enable the enclosure to be used even before such straps are fitted.

In accordance with the first and fourth aspects of the invention, a backing means in the form of a pad 58 is provided which is a generally rectangular shaped envelope comprising an upper layer 60 and a lower layer 62. The layer 60 and layer 62 are attached around their edges so as form the envelope with interior space 64. The space 64 contains sand. The pad 58 corresponds generally in shape to a rectangle of a size which is defined by the sides 44, the front 42 and rear 46 edges of the shell 40. Side portions 66 of the pad 58 are turned upwards so that portions of the upper layer 60 can be brought into contact with the outside lower edges of the shell 40. The side portions 66 of pad 58 are attached to the shell 40 by hook and loop fabric strips 68.

The pad 58 has an access tube 70 which connects the space 64 with the surrounding atmosphere. The tube 70 includes a two-way valve 72.

A layer of foam rubber 74 is attached to upper layer 62 of the pad 58 in order to insulate and provide the patient with a degree of comfort.

In use the pad 58 is spread out flat on a surface. The patient is laid face up on the pad 58 and the shell 40 is placed over the patient's chest. The weight of the patient deforms the pad 58 so that it forms an impression of the contours of the patient's back. The shell 40 is then attached to the upturned portions 66 of the pad 58 by way of the strips 68. A vacuum pump (not shown) is connected to pipe 70 and switched on. Tap 72 is opened in order to allow air to be drawn out of the space 64. As the air is drawn out the pad 58 the particles are compressed together so that the pad "hardens" and fixes the impression of the patient's back therein. What results is a hard lower surface 62 and a softer upper surface 60. The shell 40 and the pad 58 both seal against the patient's body in a substantially air-tight manner so as to completely encase the patient's chest and associated back region. The stiffening of the pad 58 causes the upturned side portion connected to the shell 40 to act as support members against any movement of sides of the shell caused by pressure changes inside the shell. The hardened pad 58 therefore provides a relatively rigid support for the shell 40 and assists in the sealing of the shell 40 to the patient whilst maintaining a degree of comfort to the patient.

The pad 58 is made from rubber or a flexible plastics material. The space 64 inside the pad 58 can be filled with sand or small particles or beads of plastics material, glass or metal.

Many modifications and variations of the embodiments of the invention described above are possible within the scope of the invention.

I claim:

1. A chest enclosure for use in producing assisted ventilation of the lungs of a patient comprising:

a chest covering shell of springy material for fitting over a patient's chest, said shell having a front portion for extending across a patient's chest, a rear portion for extending across a patient's abdomen and opposed side portions for extending over respective sides of a patient's body, each of said front, rear, and side portions having a free edge, a sealing assembly for sealing the free edges of the front, rear, and side portions of the shell directly against a patient's body, an air passageway into said enclosure for connection in use to an air oscillator, a support structure comprising a base member to be located beneath a patient's back, one or more support members projecting from said base member, and said shell being engageable with said support member or members, whereby to restrain bowing of the side portions of the shell in response to sub-ambient pressure within the shell.

2. An enclosure as claimed in claim 1, wherein the or each member takes the form of a support column having a series of locations along its length at which engagement means on said shell can be engaged with the column so that the height of the top of the shell when the shell is engaged with the support members is user selectable.

3. An enclosure as claimed in claim 1, comprising at least a pair of said support members rising from said base member, one of said pair being disposed on each side of the patient in use so that a patient lies between the support members and the shell is engaged by both support members of the pair.

4. An enclosure as claimed in claim 3, wherein the shell is engaged by the support members at a location toward the top of the shell.

5. An enclosure as claimed in claim 3, wherein one support member of the or each pair of support members is temporarily removable from the base member to allow the base member to be slid underneath a patient with minimal lifting of the patient.

6. An enclosure as claimed in claim 3, wherein the space between the or each pair of support members is upwardly open so that a patient fitted with a chest enclosure shell can be lowered between the two columns of the pair and the shell can then be engaged with the support members.

7. An enclosure as claimed in claim 3, wherein the support members are sufficiently flexible to be deflectable apart to receive a said shell and to spring inwards to grip the shell located between them and are provided with a series of tooth formations engagable by a dog or tongue provided on the adjacent portion of the shell.

8. An enclosure as claimed in claim 1, wherein engagement means is provided on the shell which is protrudable toward the support member to engage therewith to locate the shell on the support member.

9. An enclosure as claimed in claim 1, wherein the base member comprises an evacuatable envelope having an opening for the evacuation of air thereform and containing a multitude of small particles such that the envelope is normally flexible and able to be conformed to a patient's body but upon evacuation of air therefrom becomes stiff.

10. An enclosure as claimed in claim 1, wherein said shell has connection in use to an air oscillator, a front edge portion, opposed side edge portions and a rear edge portion, and means for sealing said edge portions against a patient's body, said sealing means including a sealing flap of resilient, flexible, air impermeable material running continuously around said front, side and rear edge portions.

11. An enclosure as claimed in claim 1, wherein said sealing assembly comprises a sealing member of resilient flexible, air impermeable material running over the front, rear and side edge portions of the shell wherein at least part of the sealing member is inwardly directed so as to overlie the surface of a patient's body in use in such a way that super-ambient pressure within said enclosure presses said sealing member more closely against said patient's body.

12. A chest enclosure for use in producing assisted ventilation of the lungs of a patient comprising a chest covering shell of springy material for fitting over a patient's chest, said shell having side portions for extending over sides of a patient's body, an air passageway into said enclosure for connection in use to an air oscillator, a front edge portion, opposed side edge portions and a rear edge portion, and means for sealing said edge portions against a patient's body, wherein the said sealing means includes an inwardly directed sealing member of resilient, flexible, air impermeable material running over part or all of said front, rear and side edge portions and so directed as to overlie a surface of a patient's body in use in such a way that super-ambient pressure within said enclosure presses said sealing member more closely against a patient's body.

13. An enclosure as claimed in claim 12, wherein said sealing member takes the form of a sealing flap extending inwardly from the edge of the shell or from a sealing member attached to the edge of the shell.

14. An enclosure as claimed in claim 13, wherein the flap runs continuously over the whole of the front, rear and side edge portions of the shell.

15. An enclosure as claimed in claim 12, further comprising backing means for location behind a patient's back in use and connected to said shell alongside portions thereof for holding said shell in place, wherein said backing means comprises an evacuatable envelops having an opening for the evacuation of air therefrom and containing a multitude of small particles such that the envelope is normally flexible and able to be conformed to a patient's body but upon evacuation of air therefrom becomes stiff.

16. An enclosed as claimed in claim 12, wherein the flap is of 2 to 5 cm in width and form 3 to 10 mm in thickness.

17. An enclosure as claimed in claim 12, wherein said sealing means includes a second flap of resilient, flexible, air-impermeable material running over part or all of said front, rear and side edge portions and directed away from the interior of the enclosure.

18. An enclosure as claimed in claim 17, wherein those portions of the second flap extending along the side edge portions of the shell are so disposed as to engage against a patient's back.

19. A chest enclosure for use in producing assisted ventilation of the lungs of a patient comprising a chest covering shell for fitting over a patient's chest, said shell having an air passageway to said enclosure for connection in use to an air oscillator, and backing means connected to said shell for location behind a patient in use, wherein the said backing means comprises an evacuatable envelope having an opening for the evacuation of air therefrom and containing a multitude of small particles such that the envelope is normally flexible and able to be conformed to a patient's body but upon evacuation of air therefrom becomes stiff.

20. An enclosure as claimed in claim 19, wherein the shell is connected to the backing means along side portions of the shell in a substantially air-tight manner.

21. An enclosure as claimed in claim 20, wherein the said connection is by means of male and female hook and loop fabric strips on said shell and on said backing means.

22. An enclosure as claimed in any one of claims 19 to 21, wherein the backing means further includes an upper layer of soft material.

* * * * *